United States Patent [19]

Jütte et al.

[11] 4,022,029

[45] May 10, 1977

[54] USEFUL IMPROVEMENTS IN APPARATUS FOR, AND IN METHODS OF, CONSTRUCTING A TUNNEL

[75] Inventors: Hans Jütte, Dortmund-Brechten; Siegmund Babendererde, Munich; Reinhard Bokemeyer, Bad Vilbel; Adolf Foik, Offenbach, all of Germany

[73] Assignees: Gewerkschaft Eisenhutte Westfalia, Wethmar near Lunen; Hochtief AG, Frankfurt, both of Germany

[22] Filed: Dec. 10, 1975

[21] Appl. No.: 639,504

[30] Foreign Application Priority Data

Feb. 27, 1975 Germany ..... 2508407

[52] U.S. Cl. ..... 61/85; 61/42; 61/84

[51] Int. Cl.[2] ..... E01G 3/00

[58] Field of Search ..... 61/84, 85, 42, 45 R; 299/31, 33, 55, 56, 60

[56] References Cited

UNITED STATES PATENTS

| | | | |
|---|---|---|---|
| 748,809 | 1/1904 | Stone | 61/85 |
| 3,306,055 | 2/1967 | Tabor | 61/85 |
| 3,379,024 | 4/1968 | Wohlmeyer | 299/31 X |
| 3,487,649 | 1/1970 | Bergstrom | 61/42 X |
| 3,731,977 | 5/1973 | Benedek et al. | 61/85 X |
| 3,800,549 | 4/1974 | Lobbe | 61/42 X |
| 3,818,713 | 6/1974 | Lobbe | 61/85 |
| 3,859,810 | 1/1975 | Winberg et al. | 61/42 X |

*Primary Examiner*—Dennis L. Taylor
*Attorney, Agent, or Firm*—Sughrue, Rothwell, Mion, Zinn & Macpeak

[57] ABSTRACT

A tunnel driving apparatus and method which utilizes a drive shield preferably composed of a series of cutter planks arranged side-by-side around the tunnel axis and supported by a frame. The shield is advanced in relation to the frame by displacing the individual planks, and the frame is subsequently drawn up by means of hydraulic rams. To support the rear section of the tunnel wall a rear shield is provided which is connected to the frame preferably through further rams. This shield is a shaped sheet metal structure open towards the floor and contacting the tunnel wall over the roof and sides. In performing the method, lining elements of circular or arcuate form are installed inside the rear shield prior to its shifting up. These elements can be disposed on a floor lining constructed in situ. As the rear shield is moved up fluid concrete is sprayed or otherwise introduced over the exposed tunnel wall in one or more layers to consolidate the lining elements into the support lining thus formed.

27 Claims, 7 Drawing Figures

USEFUL IMPROVEMENTS IN APPARATUS FOR, AND IN METHODS OF, CONSTRUCTING A TUNNEL

BACKGROUND TO THE INVENTION

The present invention relates to apparatus for, and a method of, constructing a tunnel, gallery or the like, hereinafter collectively referred to as a tunnel.

Various forms of apparatus are known for constructing tunnels underground. One form of apparatus, with which the invention is mainly concerned, employs a drive or cutting shield composed of elongate members or planks supported in side-by-side relationship around the tunnel so as to contact the wall thereof at least over the roof and side zones. These members are mounted on a rigid frame and are moved, usually by hydraulic rams, to attack a working face. As the tunnel driving progresses the frame is moved up to follow the advanced members. In other constructions the drive shield is in the form of a continuous cylinder advanced by rams rather than separate members. Hitherto various methods have been employed to support the tunnel wall behind the drive shield or its frame. One method which is often employed is to install pre-fabricated lining sections end-to-end as the driving progresses. Although this method is quite successful, the tunnel wall exposed by the shifting of the frame usually remains unsupported for some time until the appropriate lining sections can be placed in position. To overcome this problem other systems have been adopted which employ some form of temporary support for the exposed tunnel wall. However, this necessitates extra equipment and often involves a considerable extension in the overall length of the apparatus and this in turn creates additional problems particularly in that the overall progress of constructing the tunnel may be slowed down. Another problem frequently encountered with the generally known form of apparatus is that the control or guidance of the drive shield is difficult and there is a tendency for the shield to rotate about its axis. Another problem also encountered is that efficient drainage of water is sometimes difficult to achieve without recourse to pumping equipment which is undesirable in the cramped conditions prevailing.

With regard to the foregoing, a general object of the invention is to provide an improved apparatus for, and method of, constructing a tunnel.

BRIEF SUMMARY OF THE INVENTION

In one aspect the present invention provides an apparatus for constructing an underground tunnel; said apparatus comprising an advanceable drive shield, a frame for supporting and guiding the drive shield, means for causing relative displacement between the drive shield and the frame to effect driving and advancement of the tunnel, a movable rear shield for supporting the tunnel wall rearwardly of the frame relative to the direction of tunnel driving and means for supporting the tunnel wall exposed behind the rear shield as the latter is moved up to follow the driving progress, said supporting means including a plurality of individual preformed lining elements positioned in the rear shield before the latter is moved up.

As known per se, the drive shield can be composed of a plurality of displaceable elongate members arranged side-by-side in parallel configuration around the tunnel axis.

In general, the supporting operation can be performed separately from, and independently of, the driving operation and does not slow down the driving progress. The driving forces can be absorbed by the drive shield and its frame without interfering with the rear tunnel components. The shifting of the rear shield can also be performed separately from the shifting of the frame so that, for example, the drive shield and frame may move through several shifting cycles before the rear shield is shifted.

In a preferred form of construction, the rear shield is a shaped structure which extends only over the roof zone and part of the side wall zones of the tunnel. This rear shield can have a maximum length dimension at the roof.

In another aspect the present invention provides a method of constructing an underground tunnel; said method comprising driving the tunnel by advancing a drive shield in a longitudinal direction in relation to a frame which supports and guides the shields, shifting the frame forwardly up to the shield when the shield has been advanced, placing a plurality of individual pre-formed lining elements into a rear shield disposed rearwardly of the frame relative to the direction of tunnel driving, shifting the rear shield forwardly to expose the lining elements and utilizing the lining elements to support the tunnel wall exposed behind the rear shield as the latter is shifted up.

The rear shield can be shifted forwardly either with the frame or separately. In accordance with the invention the tunnel wall surface exposed by shifting of the rear shield can be fully supported directly it becomes accessible by introducing fluid concrete, for example by spraying, over the lining elements. The entire tunnel wall surface may be progressively treated so that only a minimal area remains exposed when the shield moves up.

The pre-formed lining elements, which may be of circular or arcuate form and which are placed into the rear shield, are left in position adjacent the tunnel wall surface when the rear shield is shifted and do not impede the latter. At this stage these elements can be at least partially encased in a concrete layer formed by spraying or otherwise introducing fluid concrete over the tunnel wall surface.

The supporting operation may involve placing the lining elements into the rear shield so as to lie adjacent at least the roof and side wall zones and spraying or introducing fluid concrete over the tunnel wall exposed when the rear shield is shifted so as to contain at least part of the lining elements. Preferably a floor lining is formed inside the rear shield by spraying or introducing fluid concrete or by installing pre-cast lining prior to the installation of the lining elements which extend over the roof and side wall zones. To reinforce the concrete, wire mesh mats can be installed between the lining elements. The creation of the floor lining enables the elements to be mounted in or on this lining within the rear shield prior to shifting. The floor lining produced by fluid concrete can be extended right up the sides of the shield and progressively increased in height in the rearward direction to contain part of at least some of the lining elements. In general, the fluid concrete may be sprayed or introduced in layers. A technique can be employed whereby the fluid concrete is sprayed or introduced over the roof zone of the elements externally of the rear shield and installed in a preceding operative cycle so as to form a layer which is also extended into the rear shield and wherein the gap formed between this layer and the tunnel wall roof surface when the rear shield is shifted is thereafter filled with fluid concrete.

Preferably a platform is disposed in the frame and supports means for detaching and conveying material from a working face at the front of the drive shield.

The invention may be understood more readily, and various other features of the invention may become more apparent, from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
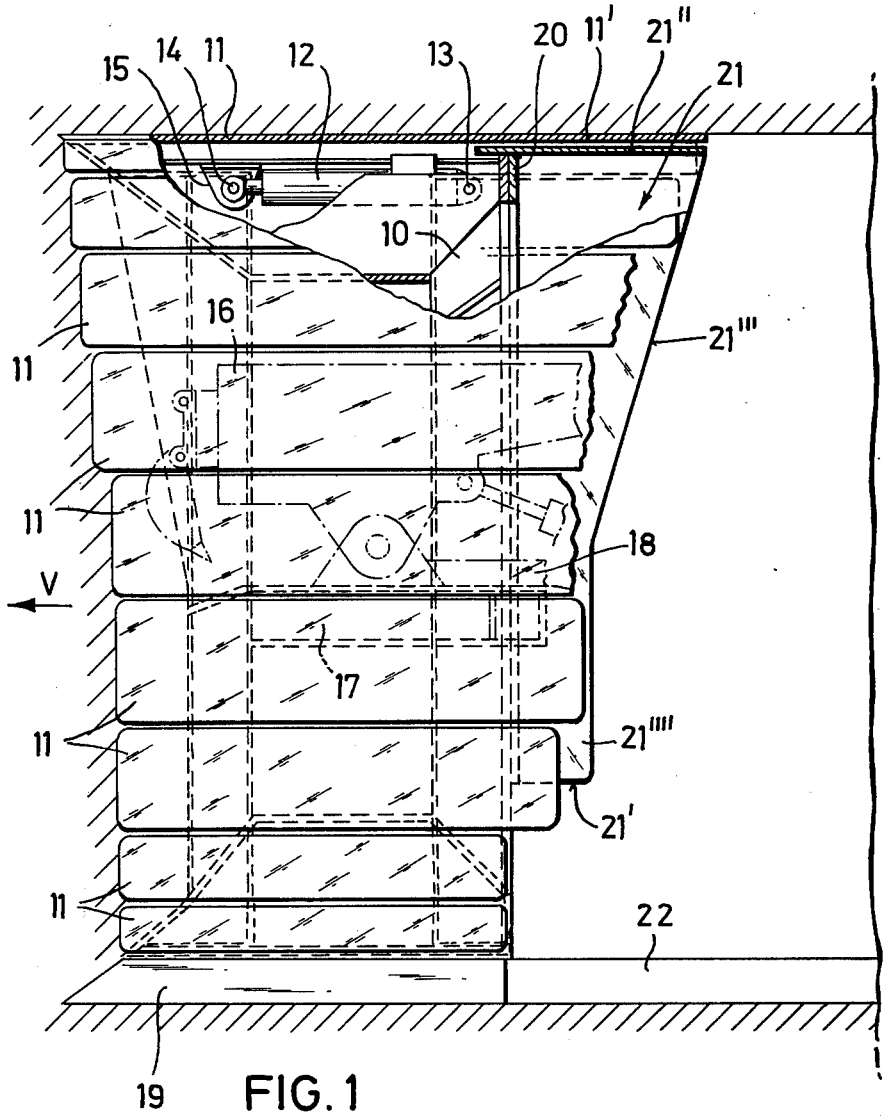
FIG. 1 is a schematic part-sectional side view of one form of apparatus made in accordance with the invention.

The apparatus represented generally in FIGS. 1 to 7 employs a drive or cutting shield composed of a series of elongate members 11 arranged side-by-side in parallel configuration around the axis of a tunnel. The individual members 11 are shown separately in FIGS. 1 and 2. The members 11 are supported and guided by means of an annular frame 10 and have cutting edges at the forward ends to attack and penetrate the working face when thrust forwards (arrow V) by means of double-acting hydraulic rams 12. Each ram 12 may serve to shift a single member 11, as illustrated, or a group of members 11. In this construction, each ram 12 has its cylinder pivotably connected to the frame 10 and its piston rod articulated as at 14 (FIG. 1) to a bracket 15 formed on the inside of an associated one of the members 11. Extension of any one ram 12 will shift the member 11 or members 11 operably connected thereto parallel to the axis of the tunnel. During the driving of the tunnel, the rams 12 are extended one after another to advance the individual members or groups of members 11, and the frame 10 and the stationary members 11, which are in frictional contact with the tunnel wall, collectively act as an abutment for the ram 12 which is extended. When all the rams 12 have been extended in this way, all the members 11, and hence the entire drive shield, are fully advanced and thereafter the rams 12 are operated in unison to retract and draw up the frame 10 towards the advanced shield. Here, all the members 11 collectively act as an effective abutment for the rams 12 by virtue of their frictional contact with the surrounding tunnel wall. At this stage, or prior to the shifting of the frame 10, the material at the working face within the members 11 can be detached and conveyed away ready for the next shifting sequence commencing with the successive advancement of the members 11.

In order to detach and convey away the debris material from the working face, the apparatus utilizes a device 16 only represented schematically in chain-dotted lines. This device is supported by a platform 17 mounted at about the horizontal centre of the apparatus and secured to the frame 10. The platform 17 additionally supports a conveyor 18 also represented schematically in chain-dotted lines. The device 16 serves in known manner to transfer debris material from the face to the conveyor 18 for subsequent removal from the forward tunnel driving region.

Figure 2:
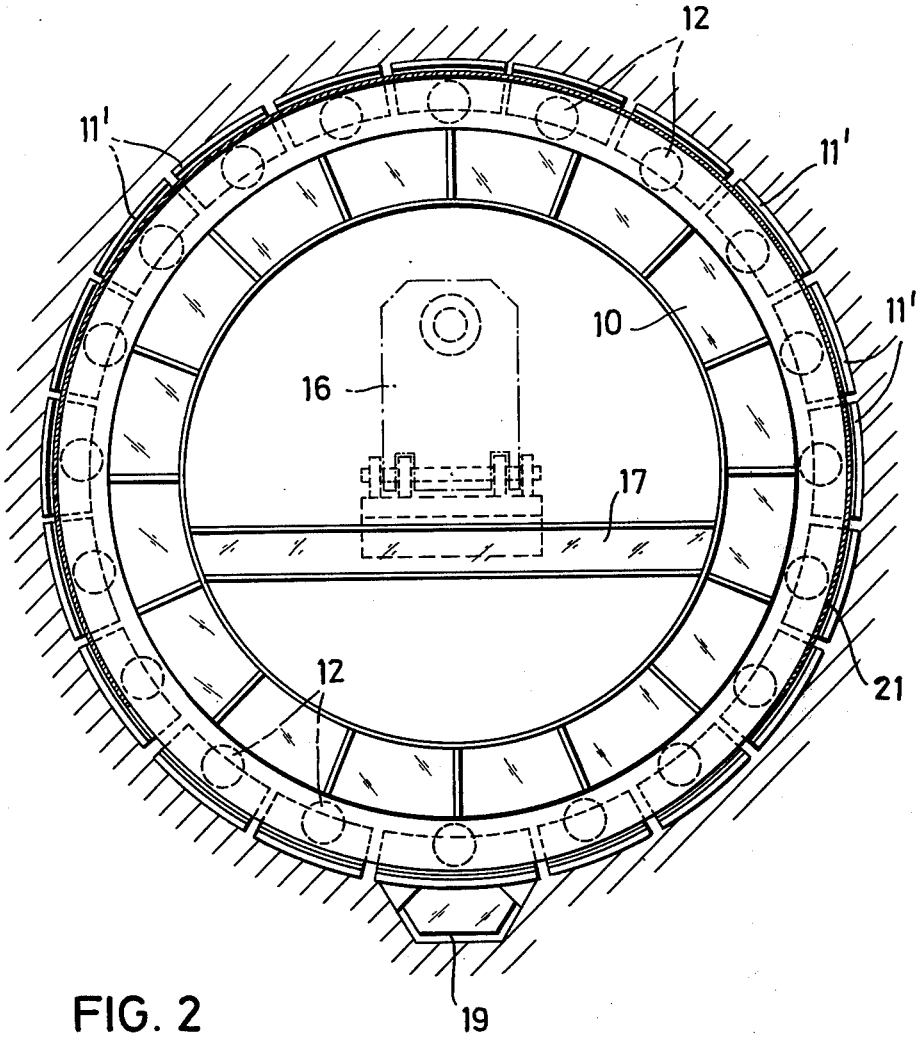
FIG. 2 is a part-sectional rear end view of the apparatus shown in FIG. 1.

As can be seen from FIG. 2, the lowermost floor member 11 of the shield is provided with a special cutter 19 of the illustrated shape which projects radially outwards of the shield into the floor of the tunnel to produce a drainage channel into which water can collect. Instead of a single cutter 19, several cutters can be provided for this purpose on one or several of the floor region members 11.

As shown in FIG. 1, the rear end of the support frame 10 is provided with an annular flange which engages with a similar annular flange 20 provided at the front end of a separate rear shield 21. The flanges of the frame 10 and shield 21 are preferably detachably secured to one another, for example by means of screws, nuts and bolts or similar fastenings. Alternatively, an additional set of hydraulic rams can be provided between the frame 10 and the shield 21 to enable the distance between these components to be adjusted.

The main body of the shield 21 is a continuous sheet metal structure arcuate in end view which extends over the roof zone and sides of the tunnel and terminates at lower side edges 21' somewhat above the floor of the tunnel but below the longitudinal axis of the tunnel. As shown in FIG. 2, the shield 21 has a maximum length over the roof zone as denoted by reference numeral 21'' and the rear end of the shield 21 tapers inwardly over an arcuate portion 21''' so that the length of the shield 21 decreases in the downward direction over its upper part. The portion 21''' terminates in the vicinity of the longitudinal axis of the tunnel and the adjoining lower portions of the end extend more or less vertically to the terminal edges 21'. Thus the lower side parts 21'''' of the shield 21 have a constant length.

The rear follow-up shield 21 serves to protect and support the tunnel wall over the roof and sides immediately behind the drive shield, but the floor zone extending approximately over the lower third of the tunnel cross-section is not contacted by the shield 21 and supported.

Figure 3:
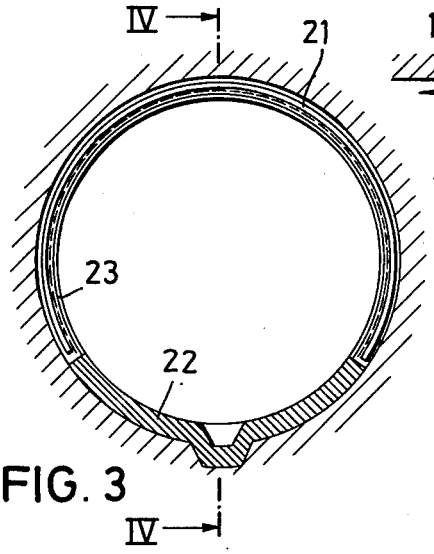
FIG. 3 is a cross-sectional view of the apparatus shown in FIGS. 1 and 2.
Figure 4:
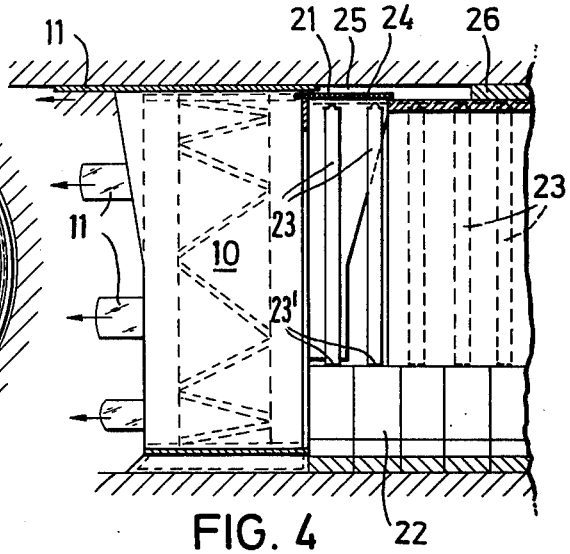
FIG. 4 is a sectional side view of the apparatus shown in FIGS. 1 to 3, the view being taken along the line IV — IV of FIG. 3, and illustrating one process of forming a lining for the tunnel.

The members 11 of the drive shield have rear end portions 11' which extend between the shield 21 and the tunnel wall. These end portions 11' slidably engage on the shield 21 so that when the members 11 are urged forward by the rams 12 the end portions 11' are guided by the shield 21. Since the shield 21 is connected to the frame 10 when the latter is drawn up after all the members 11 have been advanced, the shield 21 will also be drawn up and slides along the inner faces of the end portions 11' of the members 11. As the tunnel driving proceeds, the invention provides that the tunnel wall behind the drive shield is sealed and supported by additional means as will now be described. The support for the tunnel wall rearwardly of the drive shield involves inserting lining elements into the shield 21 and providing a floor lining at least partly in the shield 21 preferably by introducing fluid concrete, for example by spraying from a nozzle, prior to the shifting of the shield 21. Referring now to FIGS. 3 and 4 where for convenience in FIG. 4 only a few of the members 11 are depicted, the initial stage of the supporting operation can involve the spraying of fluid concrete to produce a lining 22 extending over the floor and lower side walls of the tunnel up to the edges 21' of the shield 21. This lining 22 would have an axial length at least equal to that of the shield 21. Instead of spraying concrete it is feasible to use pre-cast linings 22 arranged end-to-end. When the lining 22 has set or when the pre-cast lining or linings 22 have been installed, the next step is to insert a number of separate lining elements, which can be pre-fabricated from steel, into the shield 21. These elements, denoted 23, have lower ends 23' which can rest on the upper ends of the lining or linings 22. A wire mesh mat 24 or the like is preferably arranged between adjacent pairs of elements 23 as a reinforcement for the concrete subsequently introduced. Once the elements 23 and the mat(s) 24 have been installed, the shield 21 can be shifted up with the frame 10 to follow the members 11. As the shield 21 moves forward, a narrow gap 25 (FIG. 4) is formed between the wall of the tunnel formerly facing the exterior of the shield 21 and the elements 23 and the mat(s) 24, which remain stationary. Fluid concrete can now be sprayed to fill the gap 25 and to fill the gap(s) between the individual elements 23. In this way a concrete lining 26 (FIG. 4) is formed which contains at least part of the elements 23. An additional layer of concrete can be built up to contain the mats 24. The shape of the shield 21 also enables the initial so-called floor lining 22 formed by the spraying of the concrete to be progressively increased in height in a rearward axial direction so that the element(s) 23 at the rear end of the shield can be partially cast in the lining 22 prior to shifting of the shield 21. In this way only a comparatively small region of the tunnel wall remains unsupported between the time that the shield 21 is moved up and the concrete is sprayed again to form the lining 26 mainly over the roof zone.

Figure 5:
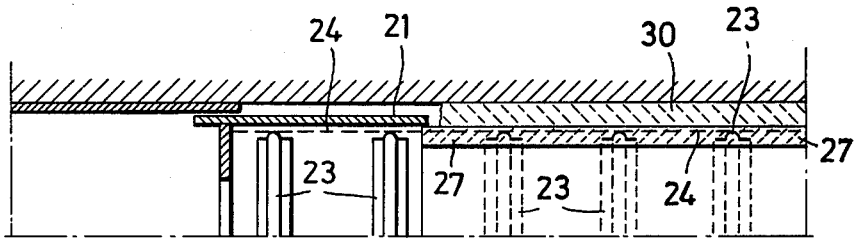
FIGS. 5 to 7 are further diagrammatic representations of the upper part of the apparatus shown in FIGS. 1 to 4 and depicting various operational stages during the formation of a lining for the tunnel.
Figure 6:
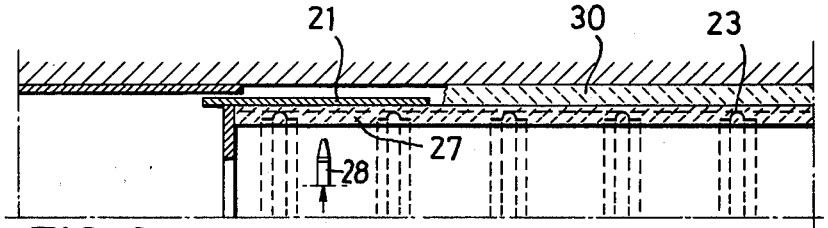
Figure 7:
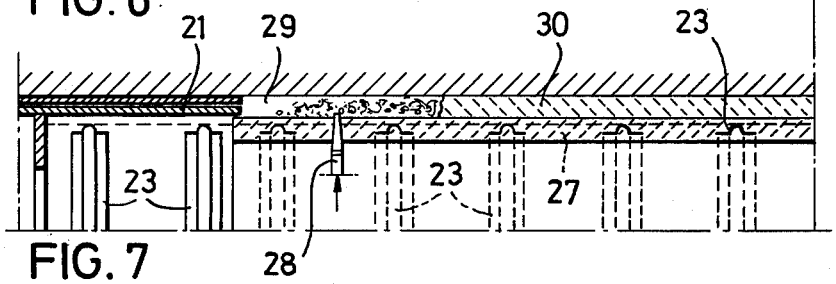

In the processes represented in FIGS. 5 to 7, a layer of concrete denoted 27 and sprayed by a gun or nozzle 28 is formed over the roof and side wall zones of the elements 23 previously installed and now disposed outside of the shield 21. As shown more particularly in FIGS. 5 and 6, this layer 27 is sprayed onto the lining 30 previously formed (c.f. 26 FIG. 4) so as to extend right into the shield 21. This layer 27 contains the mats 24 and elements 23. When the layer 27 has set and the shield 21 is ready for shifting, the floor linings 22 and the lining 30 supplemented by the layer 27 ensures that only a small gap 29 (FIG. 7) remains to be filled with the sprayed concrete to extend the lining 30 and layer 27 ready for the next cycle.

It is possible to replace the arcuate elements 23 with individual rings each made up from separate sections for example, and resting directly on the floor or on base plates. It is also possible to use expandible rings or arcuate linings which may be used to close the gap 25 (FIG. 4) with or without the use of sprayed concrete when the shield is shifted up.

We claim:

1. An apparatus for constructing an underground tunnel, said apparatus comprising a drive shield composed of a plurality of elongate members arranged side-by-side in parallel configuration and generally around the axis of the tunnel, a frame for supporting and guiding the members for longitudinal displacement, means for causing relative displacement between the frame and the members to effect driving and advancement of the tunnel, a movable rear shield for supporting the tunnel wall rearwardly of the frame relative to the direction of tunnel driving, and means for supporting the tunnel wall exposed behind the rear shield as the latter is moved up to follow the driving progress, said supporting means including a plurality of individual pre-formed lining elements positioned in the rear shield before the latter is moved up, said rear shield being discontinuous circumferentially of the tunnel to permit a floor lining to be produced directly on the floor of the tunnel to act as a support for said lining elements.

2. An apparatus for constructing an underground tunnel, said apparatus comprising an advanceable drive shield composed of a plurality of elongate members arranged side-by-side in parallel configuration and generally around the axis of the tunnel, a frame for supporting and guiding the drive shield, means for causing relative displacement between the drive shield and the frame to effect driving and advancement of the tunnel, a movable rear shield for supporting the tunnel wall rearwardly of the frame relative to the direction of tunnel driving, and means for supporting the tunnel wall exposed behind the rear shield as the latter is moved up to follow the driving progress, said supporting means including a plurality of individual pre-formed lining elements positioned in the rear shield before the latter is moved up, said rear shield being discontinuous circumferentially of the tunnel to permit one or more of the lining elements to directly contact the floor of the tunnel and thereby support the remainder of the elements.

3. An apparatus according to claim 1, wherein the rear shield extends over the sides and roof zone of the tunnel and is open towards the floor zone of the tunnel.

4. An apparatus according to claim 3, wherein the rear shield is shaped to have a maximum length dimension at the roof of the tunnel.

5. An apparatus according to claim 4, wherein the rear shield is fabricated from sheet metal and has terminal lower side edges disposed above the floor but below the longitudinal axis of the tunnel and a rear end portion which tapers inwardly from the roof of the tunnel towards the frame.

6. An apparatus according to claim 3, wherein the rear shield is secured to the frame so as to move therewith.

7. An apparatus according to claim 3, wherein hydraulic rams are connected between the rear shield and the frame.

8. An apparatus according to claim 1, wherein the elongate members engage on and are guided by the exterior of the rear shield.

9. An apparatus according to claim 1 and further comprising a platform mounted within the frame and serving to support means for detaching and conveying debris material away from a working face at the front of the drive shield.

10. An apparatus according to claim 9, wherein the platform is horizontal or substantially horizontal and is supported by the frame in an elevated position in the vicinity of the longitudinal axis of the tunnel.

11. An apparatus according to claim 1, wherein the lining elements are mountable within the rear shield so as to be disposed at least adjacent the roof and side wall zones and said supporting means further comprises means for introducing fluid concrete in one or more layers over the tunnel wall exposed when the rear shield is shifted up so as to contain at least part of the lining elements.

12. An apparatus according to claim 11, wherein the floor lining is produced by means for introducing fluid concrete onto the floor of the tunnel.

13. An apparatus according to claim 1, wherein the floor lining is produced by one or more pre-cast linings.

14. An apparatus according to claim 11, wherein wire mesh mats are provided which are placed between the lining elements prior to the formation of the concrete layer or layers.

15. An apparatus according to claim 1, and further comprising a cutter adapted to cut a drainage channel in the floor of the tunnel.

16. A method of constructing an underground tunnel utilizing the apparatus of claim 1, said method comprising the steps of driving the tunnel by advancing the drive shield in a longitudinal direction in relation to the frame which supports and guides the drive shield, shifting the frame forwardly up to the drive shield when the shield has been advanced, forming a floor lining on the floor of the tunnel inside the rear shield, placing the plurality of individual pre-formed lining elements onto the floor lining and in the rear shield, and shifting the rear shield forwardly so that the lining elements support the tunnel wall exposed behind the rear shield as the latter is shifted up.

17. A method according to claim 16, wherein the rear shield is connected to the frame and can be shifted therewith.

18. A method according to claim 17, wherein the rear shield is connected to the frame by means of hydraulic rams which are operated to adjusted the distance between the rear shield and the frame.

19. A method according to claim 16, wherein the lining elements are placed into the rear shield so as to lie adjacent at least the roof and side wall zones and the supporting operation further comprises introducing fluid concrete over the tunnel wall exposed when the rear shield is shifted so as to contain at least part of the lining elements.

20. A method according to claim 16, wherein the floor lining is formed by introducing fluid concrete onto the floor zone.

21. A method according to claim 16, wherein the floor lining is formed by means of pre-cast linings.

22. A method according to claim 20, wherein the rear shield has an inclined rear end portion which tapers from the roof towards the frame so that the maximum length dimension of the rear shield is at the roof and wherein the floor lining is extended up into the sides of the shield so as to contain part of at least some of the lining elements prior to shifting of the rear shield.

23. A method according to claim 19, wherein the fluid concrete is introduced in layers.

24. A method according to claim 23, wherein the fluid concrete is introduced over the roof zone of the elements externally of the rear shield and installed in a preceding operative cycle so as to form a layer which is also extended into the rear shield and wherein the gap formed between this layer and the tunnel wall roof surface when the rear shield is shifted is thereafter filled with fluid concrete.

25. A method according to claim 19, and further comprising introducing wire mesh mats between the elements to reinforce the concrete.

26. An apparatus according to claim 1 wherein the lining elements are of arcuate form.

27. A method of constructing an underground tunnel utilizing the apparatus of claim 2, said method comprising the steps of driving the tunnel by advancing the drive shield in a longitudinal direction in relation to the frame which supports and guides the shield, shifting the frame forwardly up to the shield when the shield has been advanced, arranging one or more of the individual pre-formed lining elements to directly contact the floor of the tunnel inside the rear shield, using said one or more elements to support the remaining elements which are subsequently placed into the rear shield, and shifting the rear shield forwardly so that the lining elements support the tunnel wall exposed behind the rear shield as the latter is shifted up.

* * * * *